US011105283B2

(12) United States Patent
Nakagawa et al.

(10) Patent No.: US 11,105,283 B2
(45) Date of Patent: Aug. 31, 2021

(54) EVAPORATED FUEL TREATMENT APPARATUS

(71) Applicant: AISAN KOGYO KABUSHIKI KAISHA, Obu (JP)

(72) Inventors: Makoto Nakagawa, Nagoya (JP); Yoshihiko Honda, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/068,992

(22) Filed: Oct. 13, 2020

(65) Prior Publication Data

US 2021/0115863 A1 Apr. 22, 2021

(30) Foreign Application Priority Data

Oct. 18, 2019 (JP) ..... JP2019-191387

(51) Int. Cl.
*F02D 41/00* (2006.01)
*F02D 41/14* (2006.01)

(52) U.S. Cl.
CPC ..... *F02D 41/004* (2013.01); *F02D 41/0042* (2013.01); *F02D 41/0045* (2013.01); *F02D 41/1454* (2013.01)

(58) Field of Classification Search
CPC ..... F02D 41/004; F02D 41/0042; F02D 41/0045; F02D 41/1454; F02D 41/062
See application file for complete search history.

(56) References Cited

U.S. PATENT DOCUMENTS

| | | | | |
|---|---|---|---|---|
| 6,095,121 | A * | 8/2000 | Osanai | F02D 41/0045 123/357 |
| 6,119,512 | A * | 9/2000 | Duty | F02D 41/2451 123/698 |
| 9,771,884 | B2 | 9/2017 | Burleigh et al. | |
| 2017/0159588 | A1* | 6/2017 | Honjo | F02D 41/263 |
| 2019/0101082 | A1* | 4/2019 | Sanuma | F02M 25/0836 |
| 2020/0032724 | A1* | 1/2020 | Asanuma | F02D 41/40 |
| 2020/0063671 | A1* | 2/2020 | Asanuma | B60K 6/46 |

FOREIGN PATENT DOCUMENTS

| | | | |
|---|---|---|---|
| JP | H01-273864 | A | 11/1989 |
| JP | H05-288107 | A | 11/1993 |
| JP | 2001-032753 | A | 2/2001 |

* cited by examiner

*Primary Examiner* — George C Jin
(74) *Attorney, Agent, or Firm* — Oliff PLC

(57) ABSTRACT

In an evaporated fuel treatment apparatus, a controller performs first purge concentration determination control by gradually increasing a purge flow rate in increments of a predetermined amount and detect a purge concentration based on a detection value of the pressure sensor. As the first purge concentration determination control, the controller performs a control to prohibit changing of an operating state of the purge pump or changing of an open state of the purge valve until a detected concentration determination time at which a variation range of the purge concentration detected based on a detection value of a pressure sensor becomes equal to or less than a predetermined value.

19 Claims, 12 Drawing Sheets

EVAPORATED FUEL TREATMENT APPARATUS

CROSS-REFERENCE TO RELATED APPLICATIONS

This application is based upon and claims the benefit of priority from the prior Japanese Patent Applications No. 2019-191387 filed on Oct. 18, 2019, the entire contents of which are incorporated herein by reference.

BACKGROUND

Technical Field

The present disclosure relates to an evaporated fuel treatment apparatus for treatment to introduce evaporated fuel generated in a fuel tank into an engine.

Related Art

U.S. Pat. No. 9,771,884 discloses that the concentration of evaporated fuel contained in purge gas (i.e., purge concentration) is determined and then a purge pump or a purge valve is controlled based on the determined purge concentration to regulate a purge flow rate to thereby adjust an air/fuel ratio (A/F).

Japanese unexamined patent application publication No. 1993-288107 discloses that, after the start of purge control, a purge flow rate, i.e., a flow rate of purge gas, is gradually increased until the purge flow rate is determined.

SUMMARY

Technical Problems

If the rotation speed of the purge pump or the opening degree of the purge valve varies unexpectedly before the purge concentration is determined, or specified, the pressure of the purge gas fluctuates, so that it takes extra time to determine the purge concentration detected based on such a fluctuating pressure of purge gas. At that time, under a situation where the purge concentration is not determined, the purge control is performed by reducing the purge flow rate in order to prevent the purge gas with a high purge concentration from being suddenly introduced into the engine. If the purge concentration could not be determined quickly, therefore, the time needed to perform the purge control by reducing the purge flow rate may be longer. This may cause a decrease in the amount of purge gas to be introduced into the engine.

The present disclosure has been made to address the above problems and has a purpose to provide an evaporated fuel treatment apparatus capable of quickly determining a purge concentration.

Means of Solving the Problems

To achieve the above-mentioned purpose, one aspect of the present disclosure provides an evaporated fuel treatment apparatus comprising: a canister configured to store evaporated fuel; a purge passage configured to allow purge gas containing the evaporated fuel to flow from the canister to an engine through an intake passage; a purge pump configured to deliver the purge gas to the intake passage; a purge valve configured to open and close the purge passage; and a controller configured to drive the purge valve under duty control while driving the purge pump to execute purge control to introduce the purge gas from the canister to the engine through the purge passage and the intake passage, wherein the evaporated fuel treatment apparatus further includes a pressure detecting unit configured to detect one of an ejection pressure of the purge pump and a front-rear differential pressure of the purge pump, and the controller is configured to execute first purge concentration determination control after starting the purge control, the first purge concentration determination control including: detecting a purge concentration representing a concentration of the evaporated fuel contained in the purge gas based on a detection value of the pressure detecting unit while gradually increasing a purge flow rate representing a flow rate of the purge gas in increments of a predetermined amount; and prohibiting either changing of an operating state of the purge pump or changing of an open state of the purge valve until a detected concentration determination time at which a variation range of the purge concentration detected based on the detection value of the pressure detecting unit becomes equal to or less than a first predetermined value.

According to the foregoing aspect, during execution of the control to determine, or specify, the purge concentration, the evaporated fuel treatment apparatus can quickly converge the variation range of the purge concentration detected based on the detection value of the pressure detecting unit. This enables quick determination of the purge concentration.

To achieve the above purpose, another aspect of the present disclosure provides an evaporated fuel treatment apparatus comprising: a canister configured to store evaporated fuel; a purge passage configured to allow purge gas containing the evaporated fuel to flow from the canister to an engine through an intake passage; a purge pump configured to deliver the purge gas to the intake passage; a purge valve configured to open and close the purge passage; and a controller configured to drive the purge valve under duty control while driving the purge pump to execute purge control to introduce the purge gas from the canister to the engine through the purge passage and the intake passage, wherein the evaporated fuel treatment apparatus further includes a pressure detecting unit configured to detect one of an ejection pressure of the purge pump and a front-rear differential pressure of the purge pump, and the controller is configured to execute second purge concentration determination control after starting the purge control, the second purge concentration determination control including: detecting a purge concentration representing a concentration of the evaporated fuel contained in the purge gas based on a detection value of the pressure detecting unit while maintaining a purge flow rate representing a flow rate of the purge gas at a predetermined flow rate; and prohibiting both changing of an operating state of the purge pump and changing of an open state of the purge valve until a detected concentration determination time at which a variation range of the purge concentration detected based on the detection value of the pressure detecting unit becomes equal to or less than a first predetermined value.

According to the foregoing aspect, during execution of the control to determine, or specify, the purge concentration, the evaporated fuel treatment apparatus can quickly converge the variation range of the purge concentration detected based on the detection value of the pressure detecting unit. This enables quick determination of the purge concentration.

Furthermore, the above configuration can increase the purge flow rate. This can further increase the total amount of the purge flow rate during execution of the control to determine the purge concentration.

To achieve the above purpose, another aspect of the present disclosure provides an evaporated fuel treatment apparatus comprising: a canister configured to store evaporated fuel; a purge passage configured to allow purge gas containing the evaporated fuel to flow from the canister to an engine through an intake passage; a purge pump configured to deliver the purge gas to the intake passage; a purge valve configured to open and close the purge passage; and a controller configured to drive the purge valve under duty control while driving the purge pump to execute purge control to introduce the purge gas from the canister to the engine through the purge passage and the intake passage, wherein after an estimated concentration determination time at which a variation range of a purge concentration representing a concentration of the evaporated fuel contained in the purge gas estimated based on an A/F of the engine becomes equal to or less than a predetermined value, the controller is configured to control a purge flow rate representing a flow rate of the purge gas and/or an injection amount of fuel to be injected by an injector to the engine based on the purge concentration estimated on the A/F of the engine.

According to the foregoing aspect, the evaporated fuel treatment apparatus can increase the purge flow rate.

Consequently, the evaporated fuel treatment apparatus in the present disclosure can determine a purge concentration quickly.

DETAILED DESCRIPTION OF THE EXEMPLARY EMBODIMENTS

A detailed description of an embodiment of an evaporated fuel treatment apparatus which is one of typical embodiments of this disclosure will now be given referring to the accompanying drawings.

<Outline of Internal Combustion Engine System>

An outline of an internal combustion engine system 100 including an evaporated fuel treatment apparatus 1 in a present embodiment will be described first and successively the evaporated fuel treatment apparatus 1 will be explained. The internal combustion engine system 100 is to be used in a vehicle, such as a car.

Figure 1:
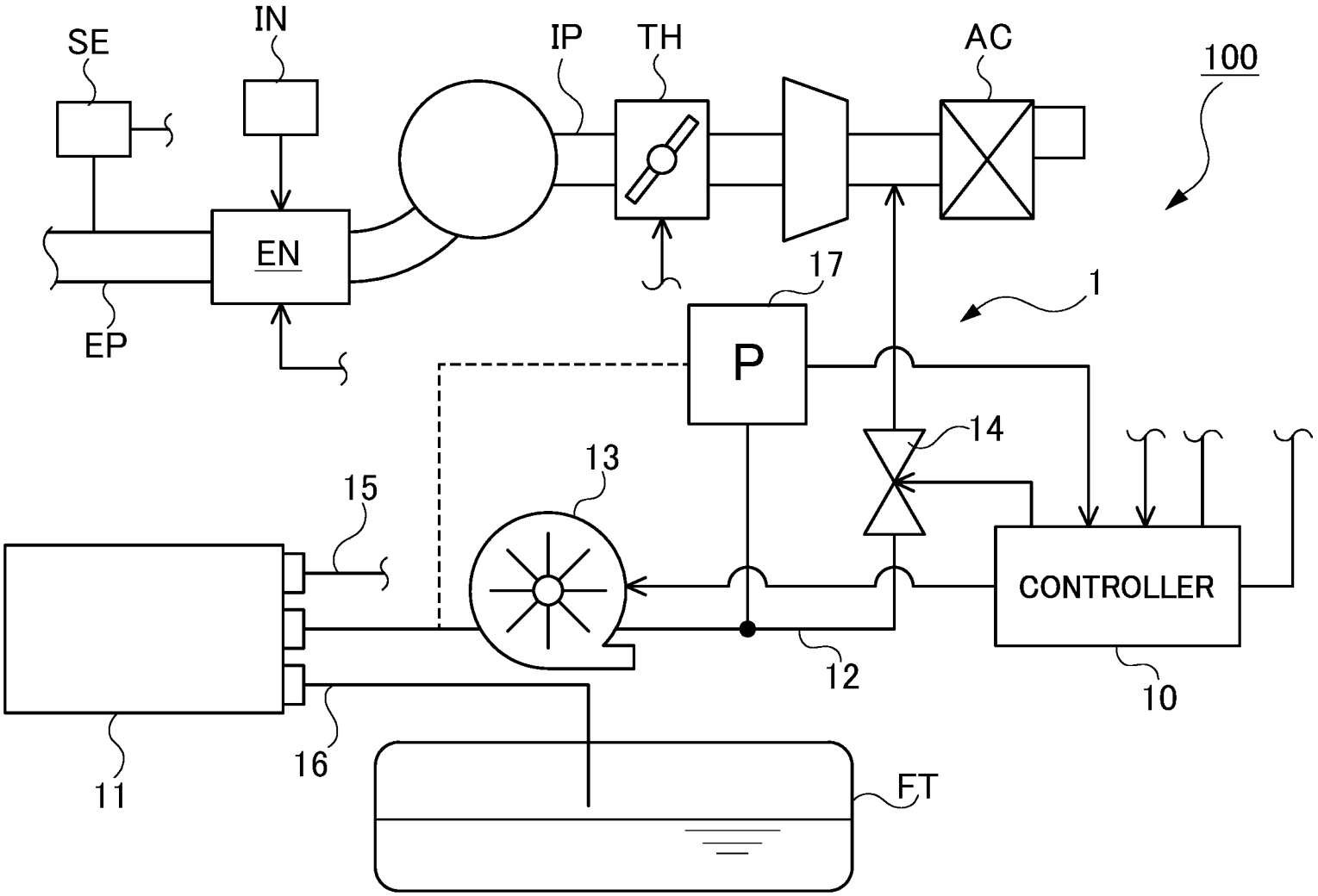
FIG. 1 is a configuration view of a whole internal combustion engine system including an evaporated fuel treatment apparatus in an embodiment.

In the internal combustion engine system 100, as shown in FIG. 1, an engine EN, i.e. an internal combustion engine, is connected to an intake passage IP for flowing air (intake air) to be supplied to the engine EN. In this intake passage IP, an electronic throttle TH, i.e. a throttle valve, is provided to open and close the intake passage IP to thereby control an amount of air (an intake air amount) allowed to flow in the engine EN. In the intake passage IP upstream of the electronic throttle TH, that is, on an upstream side in a flowing direction of the intake air, an air cleaner AC is provided to remove foreign substances from the air flowing in the intake passage IP. In the intake passage IP, therefore, the air after passing through the air cleaner AC is introduced toward the engine EN.

The engine EN is also connected to an exhaust passage EP for flowing exhaust gas discharged from the engine EN. In this exhaust passage EP, an A/F sensor SE is provided to detect an air/fuel ratio (A/F) of the engine EN, concretely, an A/F of exhaust gas discharged from the engine EN.

The internal combustion engine system 100 includes the evaporated fuel treatment apparatus 1. This evaporated fuel treatment apparatus 1 is configured to introduce purge gas for treatment into the engine EN through the intake passage IP, the purge gas containing evaporated fuel generated in a fuel tank FT that stores a fuel to be supplied to the engine EN.

The internal combustion engine system 100 further includes a controller 10. This controller 10 is a part of an ECU (not shown) mounted in a vehicle. As an alternative, the controller 10 may be provided separately from the ECU. The controller 10 includes memories, such as a CPU, a ROM, and a RAM. The controller 10 is configured to control the internal combustion engine system 100 according to programs stored in advance in the memories. Furthermore, the controller 10 is configured to retrieve detection results from various sensors, such as the A/F sensor SE and a gauge pressure sensor 17 which will be described later. The controller 10 also serves as a controller of the evaporated fuel treatment apparatus 1 to control the evaporated fuel treatment apparatus 1.

<Outline of Evaporated Fuel Treatment Apparatus>

The outline of the evaporated fuel treatment apparatus 1 will be described below.

The evaporated fuel treatment apparatus 1 in the present embodiment is configured to introduce evaporated fuel from the fuel tank FT to the engine EN through the intake passage IP. This evaporated fuel treatment apparatus 1 includes, as shown in FIG. 1, the controller 10, a canister 11, a purge passage 12, a purge pump 13, a purge valve 14, an atmosphere passage 15, a vapor passage 16, the gauge pressure sensor 17, and others.

The canister 11 is connected to the fuel tank FT through the vapor passage 16 and configured to temporarily store the evaporated fuel flowing therein from the fuel tank FT through the vapor passage 16. The canister 11 communicates with the purge passage 12 and the atmosphere passage 15.

The purge passage 12 is connected to the intake passage IP and the canister 11. Accordingly, the purge gas flowing out of the canister 11, that is, gas containing the evaporated fuel, flows through the purge passage 12 and then enters in the intake passage IP. In other words, the purge passage 12 serves to allow the purge gas to flow from the canister 11 to the engine EN through the intake passage IP. Specifically, the purge passage 12 serves to introduce the purge gas from the canister 11 into the engine EN.

The purge pump 13 is placed in the purge passage 12 and configured to control a flow of purge gas in the purge passage 12. Specifically, the purge pump 13 serves to deliver the purge gas from the canister 11 into the purge passage 12 and then to the intake passage IP.

The purge valve 14 is placed in the purge passage 12 at a position downstream of the purge pump 13 in a flowing direction of purge gas, that is, on a side close to the intake passage IP. The purge valve 14 is operative to open and close the purge passage 12. While the purge valve 14 is in a closed state, the purge gas in the purge passage 12 is blocked by the purge valve 14 from flowing to the intake passage IP. While the purge valve 14 is in an open state, on the other hand, the purge gas is allowed to flow to the intake passage IP.

The purge valve 14 is driven under a duty control to continuously switch between the open state and the closed state according to a duty ratio set depending on an operating condition of the engine EN. When the purge valve 14 is in the open state, the purge passage 12 is opened, thus establishing communication between the canister 11 and the intake passage IP. When the purge valve 14 is in the closed state, the purge passage 12 is closed, thus blocking communication between the canister 11 and the intake passage IP through the purge passage 12. The open state and the closed state of the purge valve 14 are continuously switched at intervals in which a pair of one open state and one closed state which are continuous is assumed as one cycle. The duty ratio represents a ratio of a period of the open state to the closed state in the one cycle. In the present embodiment, "changing of the open state" of the purge valve 14 which will be described later indicates changing of the ratio of a period of the open state (the duty ratio). The purge valve 14 is operated at the duty ratio, i.e., with a time length of the open state, adjusted to regulate a flow rate of the purge gas.

The atmosphere passage 15 has one end that is open in the atmosphere and the other end connected to the canister 11 to allow the canister 11 to communicate with the atmosphere. In the atmosphere passage 15, the air taken from the atmosphere flows. In other words, the atmosphere passage 15 serves to take atmospheric air into the canister 11.

The vapor passage 16 is connected to the fuel tank FT and the canister 11. Thus, the evaporated fuel generated in the fuel tank FT is allowed to flow in the canister 11 through the vapor passage 16.

The gauge pressure sensor 17 is placed in the purge passage 12 at a position downstream of the purge pump 13, concretely, at a position between the purge pump 13 and the purge valve 14. The gauge pressure sensor 17 is configured to detect the downstream pressure of the purge pump 13 or alternatively a differential pressure between two points in the purge passage 12, i.e., the front and the rear of the purge pump 13, which will be referred to as a front-rear differential pressure of the purge pump 13. The pressure sensor 17 is one example of a pressure detecting unit in the present disclosure.

In the evaporated fuel treatment apparatus 1 configured as above, when purge conditions are satisfied during operation of the engine EN, the controller 10 drives the purge valve 14 under the duty control while driving the purge pump 13 to thereby execute the purge control to introduce purge gas from the canister 11 to the engine EN through the purge passage 12 and the intake passage IP.

During execution of the purge control, the engine EN is supplied with the air taken in the intake passage IP, the fuel injected from the fuel tank FT through an injector IN, and the purge gas introduced into the intake passage IP under the purge control. The controller 10 is configured to adjust the injection time of the injector IN, the valve-opening time of the purge valve 14, the rotation speed of the purge pump 13, and other conditions to adjust an air/fuel ratio (A/F) of the engine EN to an optimal value, e.g., an ideal air/fuel ratio.

<Configuration to Determine Purge Concentration>

In the present embodiment, when a fixed condition of the operation of the engine EN is satisfied (e.g., just after start-up of the engine EN, just after refueling, etc.), the controller 10 is configured to detect a purge concentration, i.e., the concentration of evaporated fuel contained in the purge gas, based on the pressure in the purge passage 12. However, just after the start of detection of purge concentration based on a detection value of the pressure sensor 17, the detected purge concentration tends to vary. Thus, it takes a certain length of time until the purge concentration is determined, or specified. At that time, under a situation where the purge concentration is not determined, the purge control is performed by reducing the purge flow rate in order to prevent the purge gas with a high purge concentration from being suddenly introducing into the engine EN. If the purge concentration could not be determined quickly, therefore, the time needed to perform the purge control by reducing the purge flow rate may be longer. This may cause a decrease in the amount of purge gas to be introduced into the engine. In detecting the purge concentration based on the detection value of the pressure sensor 17, it is therefore desired to quickly determine, or specify, the purge concentration. For quick determination of the purge concentration, in the present embodiment, the following examples exemplify a configuration to determine the purge concentration.

Example 1

Figure 2:
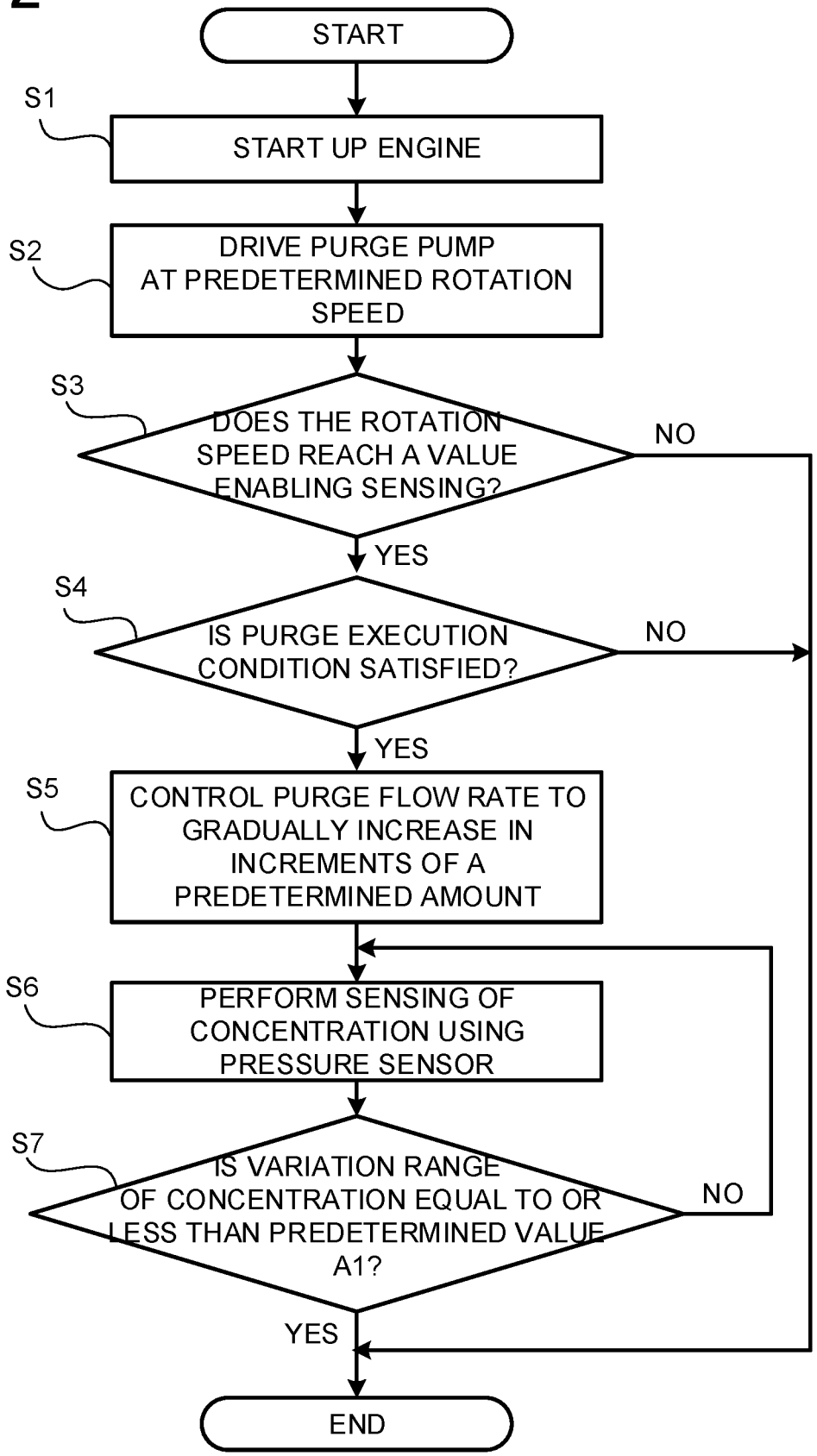
FIG. 2 is a control flowchart showing contents of control to be executed in Example 1 to determine a purge concentration.

In Example 1, the evaporated fuel treatment apparatus 1 is configured to determine a purge concentration as described below. In this example, specifically, the controller 10 is configured to perform the control shown as a control flowchart in FIG. 2. As shown in FIG. 2, the controller 10 starts up the engine EN (step S1) and drives the purge pump 13 at a predetermined rotation speed (step S2).

Figure 3A:
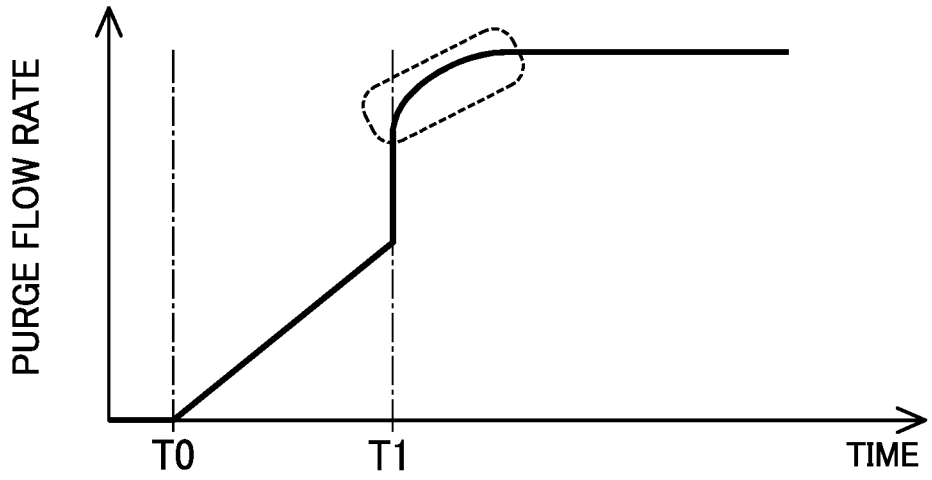
FIGS. 3A and 3B are time charts showing time variations in a purge flow rate and an opening/closing operation of a purge valve in Example 1 to determine a purge concentration.
Figure 3B:
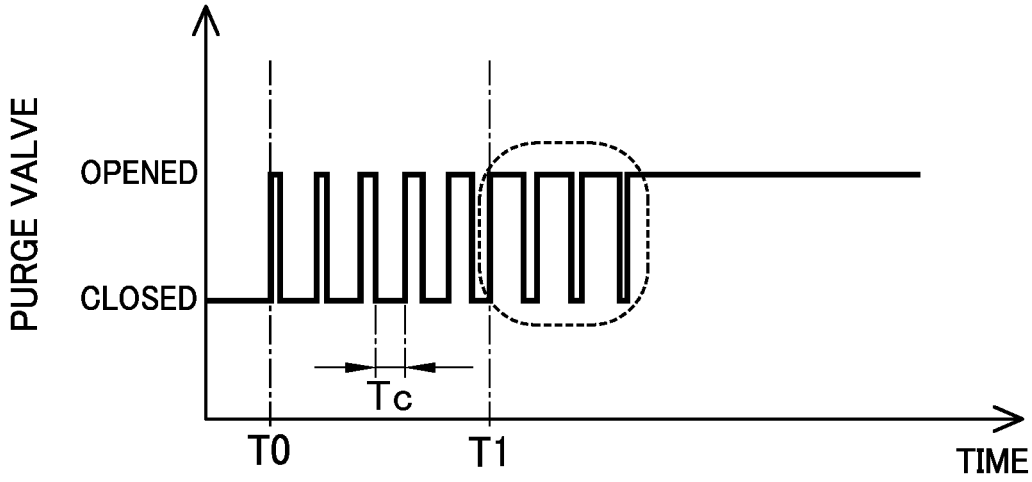

Subsequently, when the rotation speed of the purge pump 13 reaches a value representing a rotation speed enabling sensing (step S3: YES) and a purge execution condition (i.e., a condition for performing the purge control) is satisfied (step S4: YES), the controller 10 executes the purge control so as to gradually increase the purge flow rate in increments of a predetermined amount (step S5). In step S5, specifically, the controller 10 gradually increases a duty ratio for driving the purge valve 14 under the duty control (hereinafter, simply referred to as a duty ratio of the purge valve 14) as shown in FIGS. 3A and 3B while keeping the rotation speed of the purge pump 13 constant. At that time, for example, the duty ratio of the purge valve 14 is increased in increments of 5%, that is, to 5%, 10%, 15%, and subsequent values.

The "rotation speed enabling sensing" represents the rotation speed at which a purge concentration can be detected based on a detection value of the pressure sensor 17.

In the above manner, while executing the purge control to gradually increase the purge flow rate in increments of a predetermined amount (step S5), the controller 10 performs sensing of the purge concentration using the pressure sensor 17 (step S6). Specifically, the controller 10 detects the purge concentration based on a detection value of the pressure sensor 17.

The controller 10 continues to detect a purge concentration through the use of the pressure sensor 17 (step S6) until a variation range of the concentration, that is, the purge concentration detected based on the detection value of the pressure sensor 17, becomes equal to or less than a predetermined value A1 (step S7: YES). The predetermined value A1 is one example of a first predetermined value in the present disclosure, for example, 10%.

In the present example, as shown in FIGS. 3A and 3B, after starting the purge control at time T0, the controller 10 performs a first purge concentration determination control to detect the purge concentration based on the detection value of the pressure sensor 17 while gradually increasing the purge flow rate in increments of a predetermined amount as described above.

In the first purge concentration determination control, the controller 10 controls the duty ratio of the purge valve 14 to gradually increase while prohibiting changing of the operating state of the purge pump 13 until the detected concentration determination time (time T1 in FIGS. 3A and 3B) at which the variation range of the purge concentration detected based on the detection value of the pressure sensor 17 becomes a predetermined value A1 or less. The controlling of the purge pump 13 to prohibit changing of the operating state of the purge pump 13 is a control to maintain the rotation speed of the purge pump 13 at a constant value.

As a modified example, in the first purge concentration determination control, the controller 10 may control the purge pump 13 so that the rotation speed of the purge pump 13 gradually increases in increments of a predetermined value while controlling the purge valve 14 to prohibit changing of the open state of the purge valve 14 until the detected concentration determination time at which the variation range of the purge concentration detected based on the detection value of the pressure sensor 17 becomes the predetermined value A1 or less. The controlling of the purge valve 14 to prohibit changing of the open state of the purge valve 14 is a control to maintain the duty ratio of the purge valve 14 at a constant value.

In Example 1, as described above, the controller 10 is configured to execute the first purge concentration determination control in which changing of the operating state of the purge pump 13 or changing of the open state of the purge valve 14 is prohibited until the detected concentration determination time (time T1 in FIGS. 3A and 3B) at which the variation range of the purge concentration detected based on the detection value of the pressure sensor 17 becomes the predetermined value A1 or less.

Accordingly, during execution of the control to determine the purge concentration, the pressure variation in purge gas in the purge passage 12 can be decreased. This reduces the influence of the pressure variation or fluctuation of purge gas on the detection value of the pressure sensor 17, so that the variation range of the purge concentration detected based on the detection value of the pressure sensor 17 can be quickly converged. Consequently, the evaporated fuel treatment apparatus 1 in this example can promptly determine the purge concentration.

Example 2

Figure 4:
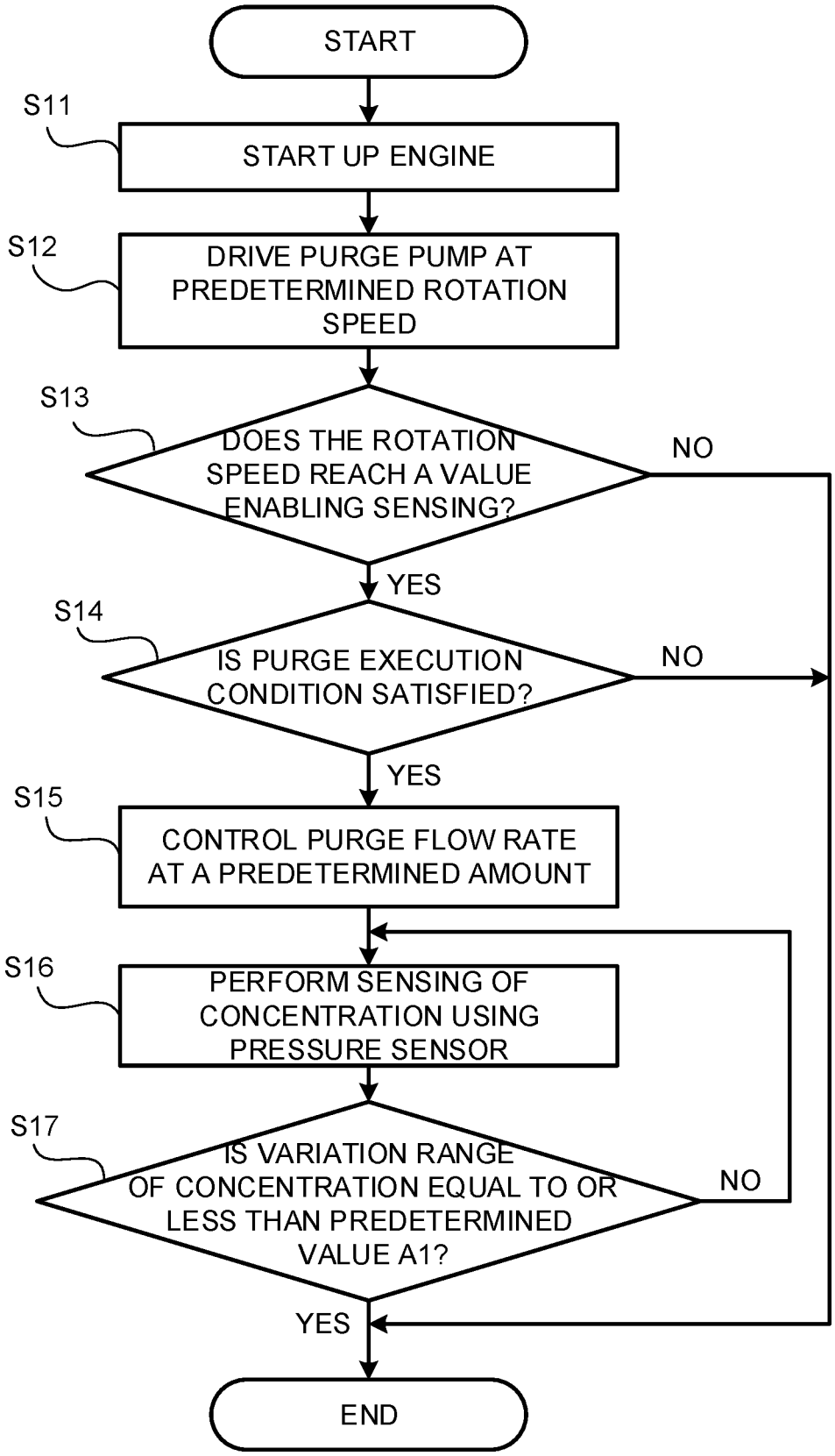
FIG. 4 is a control flowchart showing contents of control to be executed in Example 2 to determine a purge concentration.

In Example 2, the evaporated fuel treatment apparatus 1 is configured to determine a purge concentration as described below. In this example, the controller 10 is configured to perform the control shown as a control flowchart in FIG. 4. Example 2 differs from Example 1 in that, when the purge execution condition is satisfied (step S14: YES), the controller 10 controls the purge flow rate at a predetermined flow rate, that is, perform the purge control to maintain the purge flow rate at the predetermined flow rate (step S15) as shown in FIG. 4. In step S15, specifically, the controller 10 keeps constant both the rotation speed of the purge pump 13 and the duty ratio of the purge valve 14. At that time, for example, the duty ratio of the purge valve 14 is 20%. Steps S11 to S14 in FIG. 4 are the same as steps S1 to S4 in FIG. 2.

In the above manner, while controlling the purge flow rate at a predetermined flow rate (step S15), the controller 10 performs sensing of the purge concentration using the pressure sensor 17 (step S16).

Figure 5A:
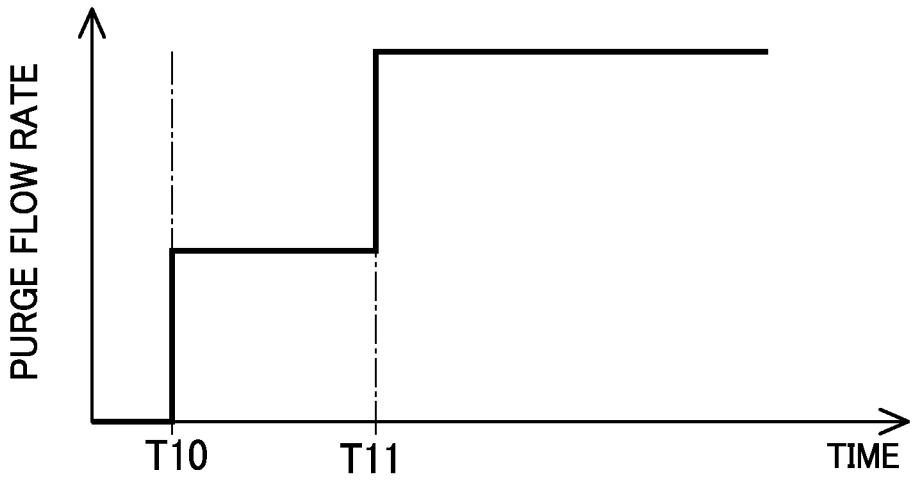
FIGS. 5A and 5B are time chart showing time variations in a purge flow rate and an opening/closing operation of a purge valve in Example 2 to determine a purge concentration.
Figure 5B:
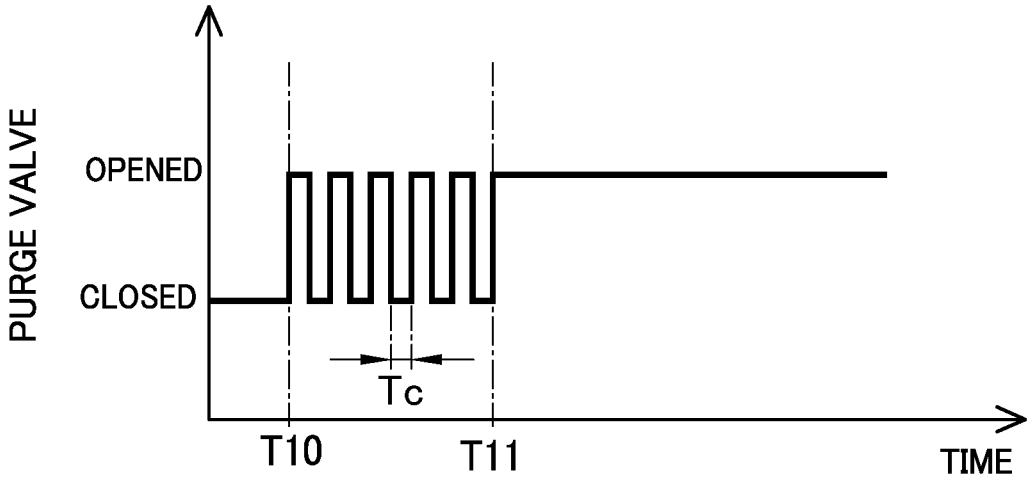

In this example, as shown in FIGS. 5A and 5B, after starting the purge control at time T10, the controller 10 performs a second purge concentration determination control to detect the purge concentration based on the detection value of the pressure sensor 17 while maintaining the purge flow rate at a predetermined flow rate.

In this example, in the second purge concentration determination control, the controller 10 prohibits both changing of the operating state of the purge pump 13 and changing of the open state of the purge valve 14 until a detected concentration determination time (time T11 in FIGS. 5A and 5B) at which the variation range of the purge concentration detected based on the detection value of the pressure sensor 17 becomes the predetermined value A1 or less (step S17: YES).

Accordingly, during execution of the control to determine the purge concentration, the pressure variation in purge gas in the purge passage 12 can be decreased. This reduces the influence of the pressure variation or fluctuation of purge gas on the detection value of the pressure sensor 17, so that the variation range of the purge concentration detected based on the detection value of the pressure sensor 17 can be quickly converged. Consequently, the evaporated fuel treatment apparatus 1 in this example can promptly determine the purge concentration.

Furthermore, since the purge flow rate is set to the predetermined flow rate immediately after the start of the purge control, the purge flow rate can be increased to a maximum extent. Thus, the total amount of the purge flow rate during execution of the control to determine the purge concentration can be increased more than in Example 1.

<Control to be Performed after Determination of Purge Concentration>

The following description is given to the control to be performed after the purge concentration is determined as described above, that is, after the detected concentration determination time at which the variation range of the purge concentration detected based on the detection value of the pressure sensor 17 becomes the predetermined value A1 or less.

Figure 6:
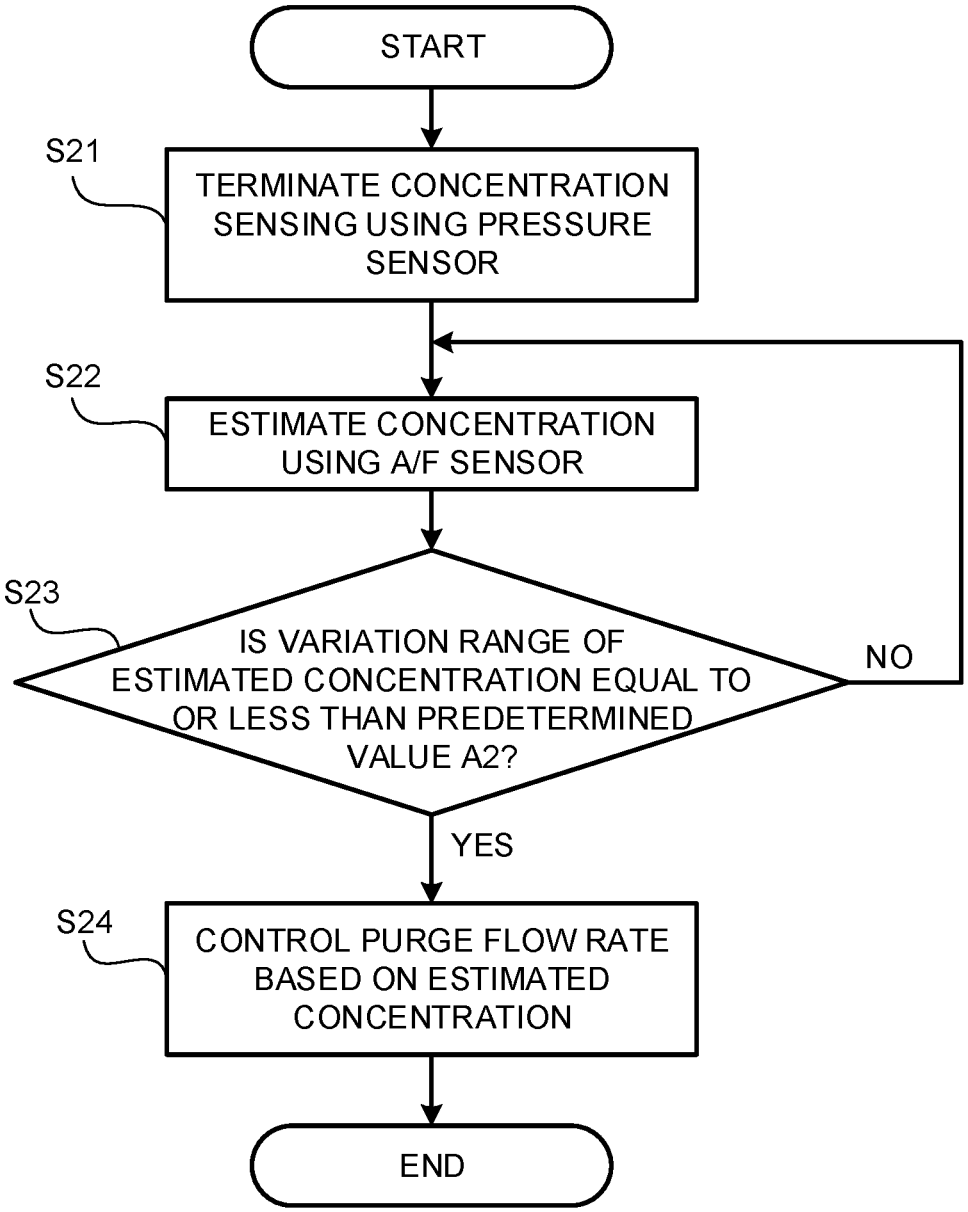
FIG. 6 is a control flowchart showing contents of the control to be executed after determination of a purge concentration.

In the present embodiment, the controller 10 is configured to perform the control shown as a control flowchart in FIG. 6 after determining the purge concentration. As shown in FIG. 6, the controller 10 firstly terminates the concentration sensing using the pressure sensor 17 (step S21), that is, stops the control to detect a purge concentration based on the detection value of the pressure sensor 17.

Successively, the controller 10 estimates a concentration using the A/F sensor SE (step S22), that is, estimates a purge concentration based on an A/F value of the engine EN detected by the A/F sensor SE. When a variation range of the estimated concentration (i.e., the purge concentration estimated based on the A/F value of the engine EN) becomes a predetermined value A2 or less (step S23: YES), the controller 10 then controls the purge flow rate based on the estimated concentration (step S24). Specifically, in step S24, the controller 10 controls the purge flow rate based on the purge concentration estimated based on the A/F value of the engine EN. The predetermined value A2 is one example of a "second predetermined value" or a "predetermined value" in the present disclosure, for example, 10%.

In step S24, the controller 10 may also control the injection amount of the injector IN based on the estimated concentration. Further, the timing at which the variation range of the concentration becomes the predetermined value A1 or less (step S7 or S17: YES) may concurrently occur with the timing at which the variation range of the estimated concentration becomes the predetermined value A2 or less (step S23: YES).

In the above manner, on or after the detected concentration determination time at which the purge concentration detected based on the detection value of the pressure sensor 17 becomes the predetermined value A1 or less, the controller 10, performs a control to estimate the purge concentration based on the A/F value of the engine EN. On or after the estimated concentration determination time at which the purge concentration estimated based on the A/F value of the engine EN becomes the predetermined value A2 or less, the controller 10 controls the purge flow rate and/or the injection amount of the injector IN based on the purge concentration estimated based on the A/F value of the engine EN.

Figure 7:
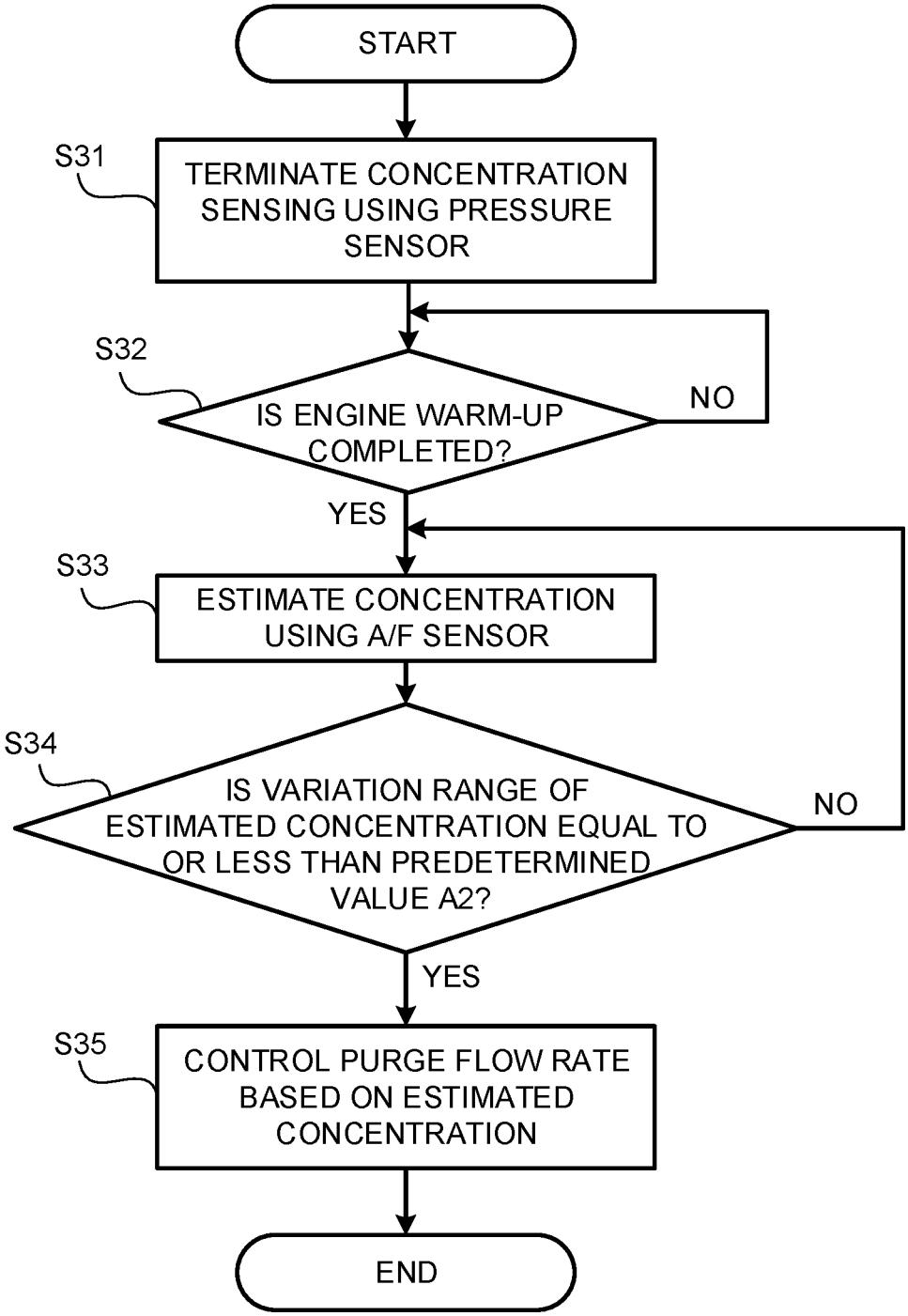
FIG. 7 is a control flowchart showing a modified example of FIG. 6.

As a modified example of the control shown in FIG. 6, the controller 10 may estimate the concentration using the A/F sensor SE (step S33) after warm-up of the engine EN is completed (step S32: YES) as shown in FIG. 7. Steps S31 and S33 to S34 in FIG. 7 are the same as steps S21 and S22 to S24 in FIG. 6.

The aforementioned control for estimating the purge concentration based on the A/F value of the engine EN may be performed after completion of engine warm-up.

As another alternative, after shifting to the concentration measurement using the A/F sensor SE, that is, after starting the control to estimate the purge concentration based on the A/F value of the engine EN (i.e., after time T1 in FIGS. 3A and 3B), as indicated by a region surrounded with a broken line in FIGS. 3A and 3B, the controller 10 may change the purge flow rate within an allowable range in the engine EN according to the adsorption amount of evaporated fuel in the canister 11.

Figure 8:
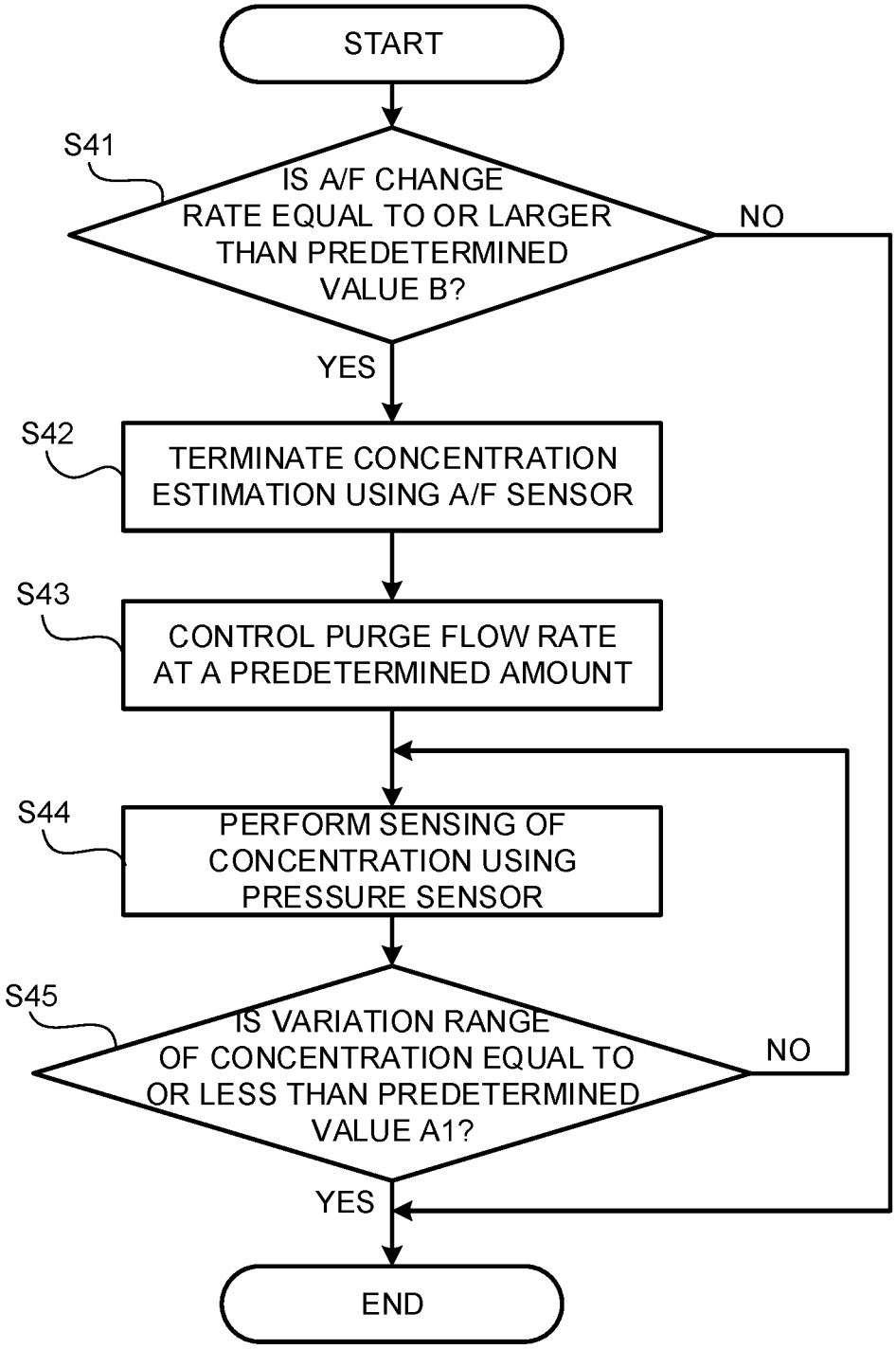
FIG. 8 is a control flowchart showing contents of control to be executed when an A/F change rate increases while the purge flow rate is controlled based on a purge concentration estimated based on a detection value of an A/F of an engine.

While controlling the purge flow rate based on the estimated concentration in step S24 in FIG. 6, when the change rate of the A/F of the engine EN increases, the controller 10 performs the control shown as a control flowchart in FIG. 8. The case "when the change rage of the A/F of the engine EN increases" includes various cases when the purge concentration suddenly changes, for example, the case when evaporated fuel suddenly increases in the fuel tank FT during refueling while the engine EN is operating and then flows in the canister, resulting in a sudden change in purge concentration, or, the case when the temperature of fuel reaches a boiling point of the fuel, causing evaporated fuel to suddenly increase.

As shown in FIG. 8, when the A/F change rate is equal to or larger than a predetermined value B (step S41), that is, when the detection value of the A/F sensor SE greatly changes, the controller 10 terminates the concentration estimation using the A/F sensor SE, that is, stops the control to estimate the purge concentration based on the A/F value of the engine EN (step S42). The predetermined value B is one example of a "predetermined change rate" in the present disclosure, for example, 30%.

The controller 10 subsequently controls the purge flow rate at a predetermined flow rate (step S43) or alternatively controls the purge flow rate to gradually increase in increments of a predetermined amount. The controller 10 then performs sensing of the concentration using the pressure sensor 17 (step S44). If the variation range of the concentration is equal to or less than the predetermined value A1 (step S45), the controller 10 terminates the sensing of the concentration using the pressure sensor 17.

In the above manner, during execution of controlling the purge flow rate based on the purge concentration estimated based on the A/F value of the engine EN, that is, on or after the estimated concentration determination time, when the A/F change rate of the engine EN becomes the predetermined value B, the controller 10 performs either the first purge concentration determination control or the second purge concentration determination control. The controller 10 thus controls the purge flow rate and/or the injection amount of the injector IN based on the purge concentration detected based on the detection value of the pressure sensor 17.

Figure 9:
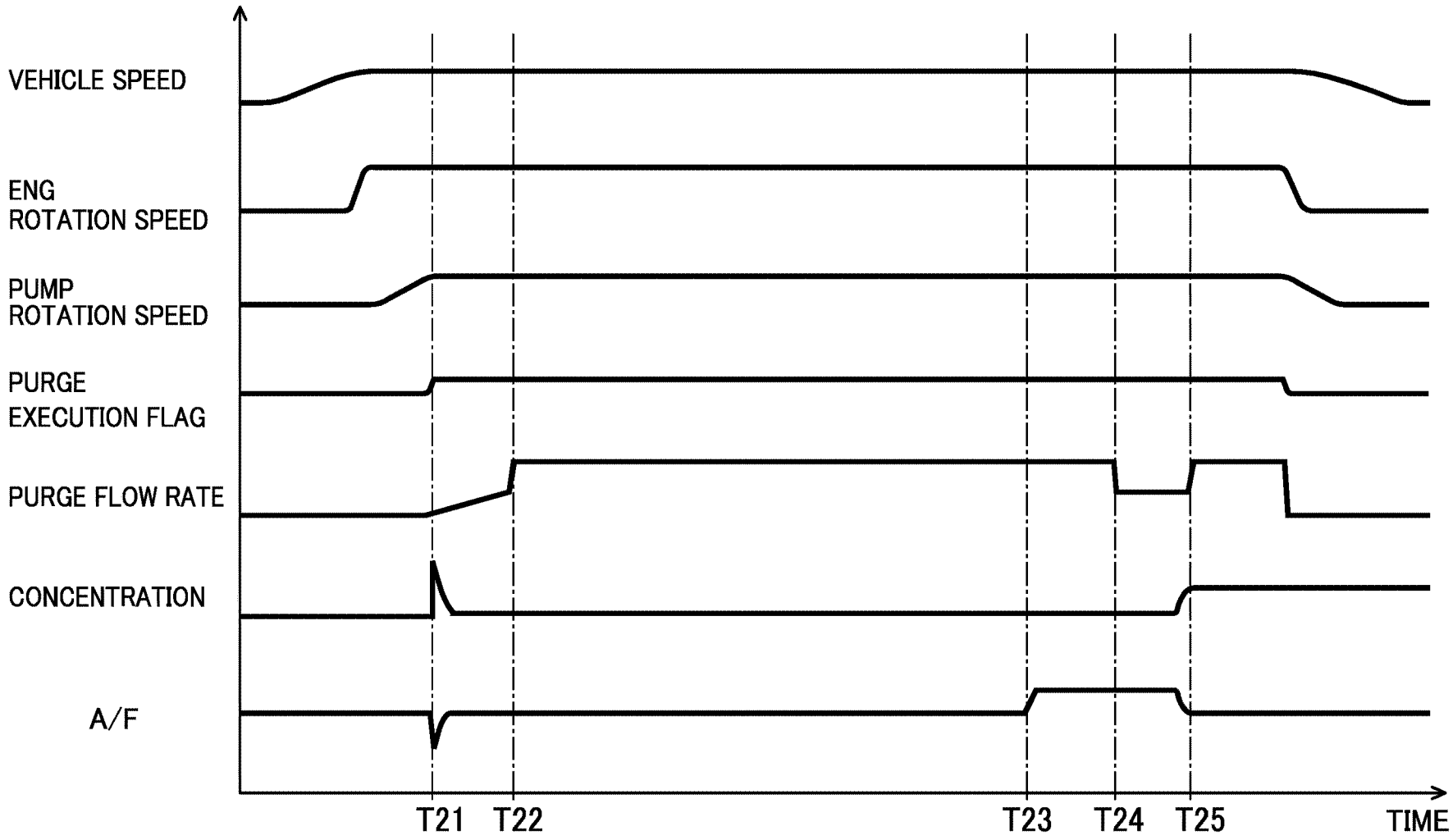
FIG. 9 is a time chart showing time variations in each item, such as a purge flow rate, detected when the control control flowchart shown in FIG. 8 is executed.

When the A/F change rate becomes equal to or larger than the predetermined value (e.g., the predetermined value B) at or after time T23 as shown in FIG. 9, as described above, the purge flow rate is controlled to the predetermined flow rate from time T24 to time T25 and then the pressure sensor 17 terminates the concentration sensing.

<Method of Controlling During First Operation and Second Operation of Engine>

Figure 10:
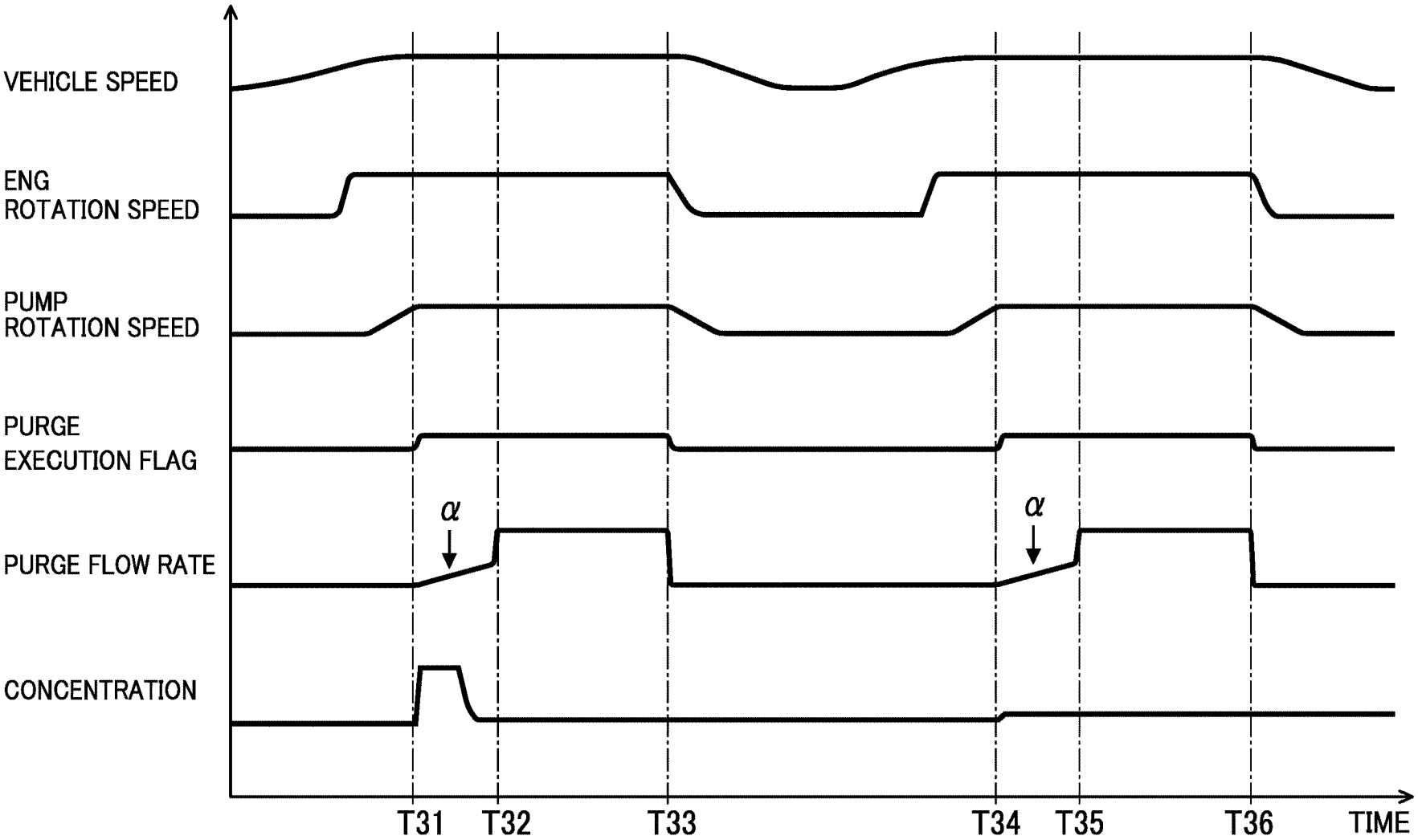
FIG. 10 is a first example of a time chart showing time variations in each item, such as a purge flow rate, during a first operation and during a second operation of the engine.
Figure 11:
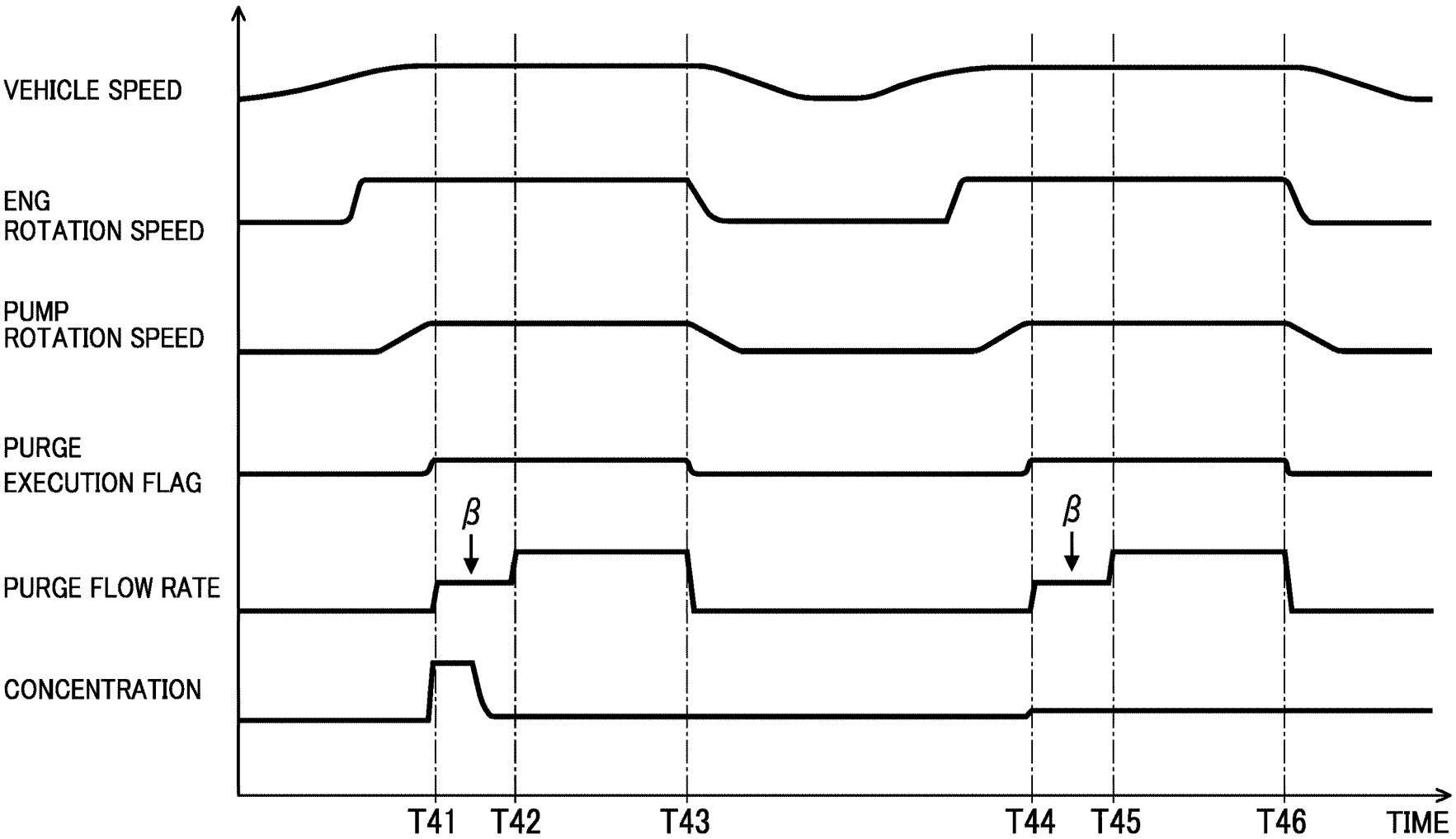
FIG. 11 is a second example of a time chart showing time variations in each item, such as a purge flow rate, during a first operation and during a second operation of the engine.
Figure 12:
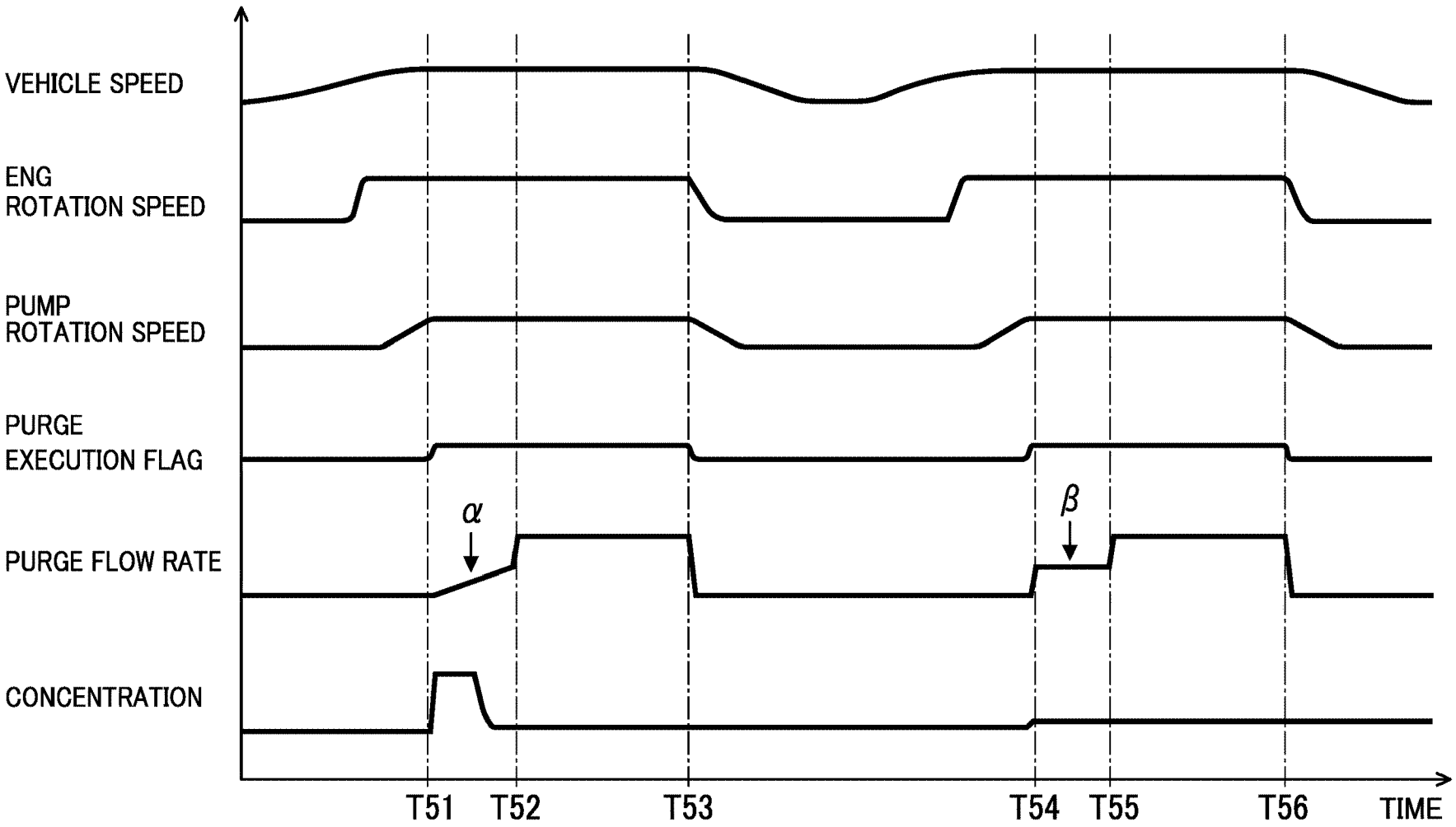
FIG. 12 is a third example of a time chart showing time variations in each item, such as a purge flow rate, during a first operation and during a second operation of the engine.

During the first operation of the engine EN that is performed after the engine EN is stopped for a long period and during the second operation of the engine EN that is performed after a short time from the first operation, the controller 10 may be configured to perform controls such as shown in time charts in FIGS. 10 to 12. It is to be understood that the "second operation of the engine EN" in the present embodiment includes second and subsequent operations of the engine EN.

In a first example, as shown in FIG. 10, in a period from time T31 to T32 in the first operation of the engine EN and in a period from time T34 to time T35 in the second operation, the controller 10 performs the first purge concentration determination control (indicated with $\alpha$ in FIG. 10) to detect a purge concentration based on a detection value of the pressure sensor 17 while gradually increasing the purge flow rate in increments of a predetermined amount.

As an alternative, it may be arranged that an increment of a purge flow rate to be gradually increased (i.e., the predetermined amount) for execution of the first purge concentration determination control may be set different between the first operation and the second operation of the engine EN. At that time, the increment of the purge flow rate to be gradually increased (i.e., the predetermined amount) for the first purge concentration determination control in the second operation of the engine EN may be set according to the purge concentration detected in the first operation of the engine EN, e.g., the concentration (the purge concentration) at time T33 in FIG. 10.

The above-described first example is carried out for example when it is assumed that a large amount of fuel has been adsorbed in the canister 11 after a long stop of the engine EN. Accordingly, the evaporated fuel treatment apparatus 1 in this first example can prevent sudden introduction of a high flow rate of purge gas into the engine EN after staring the purge control, thereby enabling to avoid the occurrence of A/F fluctuations. The A/F fluctuations are excessive variations in A/F of the engine EN.

In a second example, as shown in FIG. 11, in a period from time T41 to time T42 in the first operation of the engine EN and in a period from time T44 to time T45 in the second operation of the engine EN, the controller 10 performs the second purge concentration determination control (indicated with β in FIG. 11) to detect a purge concentration based on a detection value of the pressure sensor 17 while maintaining the purge flow rate at a predetermined flow rate.

As an alternative, it may be arranged that the purge flow rate (i.e., the predetermined flow rate) for execution of the second purge concentration determination control may be set different between the first operation and the second operation of the engine EN. At that time, the purge flow rate (i.e., the predetermined flow rate) for the second purge concentration determination control in the second operation of the engine EN may be set according to the purge concentration detected in the first operation of the engine EN, e.g., the concentration (the purge concentration) at time T43 in FIG. 11.

The above-described second example is carried out for example when it is assumed that a large amount of fuel has not been adsorbed in the canister 11. Accordingly, the evaporated fuel treatment apparatus 1 in this second example can increase the purge flow rate from the time of starting the purge control.

In a third example, as shown in FIG. 12, in a period from time T51 to time T52 in the first operation of the engine EN, the controller 10 performs the first purge concentration determination control (indicated with α in FIG. 12) to detect a purge concentration based on a detection value of the pressure sensor 17 while gradually increasing the purge flow rate in increments of a predetermined amount. On the other hand, in a period from time T54 to time T55 in the second operation of the engine EN, the controller 10 performs the second purge concentration determination control (indicated with β in FIG. 12) to detect a purge concentration based on a detection value of the pressure sensor 17 while maintaining the purge flow rate at a predetermined flow rate.

As an alternative, it may be arranged that the purge flow rate (i.e., the predetermined flow rate) for execution of the second purge concentration determination control in the second operation of the engine EN may be set according to the purge concentration detected in the first operation of the engine EN, e.g., the concentration (the purge concentration) at time T53 in FIG. 12.

The forgoing third example is conducted for example when a large amount of fuel has been adsorbed in the canister 11 after the engine EN is stopped for a long period. Accordingly, the evaporated fuel treatment apparatus 1 can prevent sudden introduction of a high flow rate of purge gas into the engine EN after starting the purge control, thereby enabling to avoid the occurrence of A/F fluctuations. In addition, the evaporated fuel treatment apparatus 1 can increase the purge flow rate from the time of starting the purge control in the second and subsequent operations of the engine EN.

Effects of the Present Embodiment

In the evaporated fuel treatment apparatus 1 in the present embodiment described as above, the controller 10 is configured to perform the first purge concentration determination control to detect the purge concentration based on the detection value of the pressure sensor 17 while gradually increasing the purge flow rate in increments of a predetermined amount after starting the purge control. In the first purge concentration determination control, the controller 10 performs the control to prohibit either changing of the operating state of the purge pump 13 or changing of the open state of the purge valve 14 until the detected concentration determination time at which the variation range of the purge concentration detected based on the detection value of the pressure sensor 17 becomes the predetermined value A1 or less.

Accordingly, during execution of the control to determine the purge concentration, the controller 10 can quickly converge the variation range of the purge concentration detected based on the detection value of the pressure sensor 17. This enables quick determination of the change rate.

After starting the purge control, the controller 10 may also be configured to perform the second purge concentration determination control to detect the purge concentration based on the detection value of the pressure sensor 17 while maintaining the purge flow rate at the predetermined flow rate. In the second purge concentration determination control, further, the controller 10 is configured to perform the control to prohibit both changing of the operating state of the purge pump 13 and changing of the open state of the purge valve 14 until the variation range of the purge concentration detected based on the detection value of the pressure sensor 17 becomes the predetermined value A1 or less.

Accordingly, during execution of the control to determine the purge concentration, the controller 10 can quickly converge the variation range of the purge concentration detected based on the detection value of the pressure sensor 17. This enables quick determination of the change rate.

Furthermore, the purge flow rate can be increased, so that the total amount of the purge flow rate during execution of the control to determine the purge concentration can be increased more than in Example 1.

On or after the detected concentration determination time at which the variation range of the purge concentration detected based on the detection value of the pressure sensor 17 becomes the predetermined value A1 or less, the controller 10 performs the control to estimate the purge concentration based on the detection value of the A/F sensor SE, that is, the A/F value of the engine EN. On or after the estimated concentration determination time at which the variation range of the purge concentration estimated based on the detection value of the pressure sensor 17 becomes the predetermined value A2 or less, the controller 10 controls the purge flow rate and/or the injection amount of the injector IN based on the purge concentration estimated based on the detection value of the A/F. The detected concentration determination time and the estimated concentration determination time may also concurrently occur.

Herein, in detecting the purge concentration based on the detection value of the pressure sensor 17, the detection value of the pressure sensor 17 obtained when the purge valve 14 is in the closed state (that is, in a valve-closing time Tc in FIGS. 3A and 3B and FIGS. 5A and 5B) is used. Thus, the duty ratio of the purge valve 14 in such a condition could not be set to 100% and accordingly the purge flow rate is restricted. In the present embodiment, therefore, on or after the purge concentration estimated based on the detection value of the A/F sensor SE is determined, i.e., on or after the estimated concentration determination time, the controller 10 controls the purge flow rate and/or the injection amount of the injector IN based on the purge concentration estimated based on the detection value of the A/F sensor SE. Thus, the duty ratio of the purge valve 14 can be set to 100% and accordingly the purge flow rate is less likely to be restricted, and the purge flow rate can be increased, Moreover, the control to estimate the purge concentration based on the detection value of the A/F sensor SE may be performed after warm-up of the engine EN is completed.

Consequently, the control to estimate the purge concentration based on the detection value of the A/F sensor SE is enabled to be performed after completion of warm-up of the engine EN and the injector IN is so warmed as to provide a stable injection amount. This makes it possible to estimate the purge concentration with enhanced accuracy.

On or after the estimated concentration determination time at which the variation range of the purge concentration estimated based on the detection value of the A/F sensor SE becomes the predetermined value A2 or less, when the change rate of the detection value of the A/F sensor SE becomes the predetermined value B or more, the controller 10 performs either the first purge concentration determination control or the second purge concentration determination control. The controller 10 controls the purge flow rate and/or the injection amount of the injector IN based on the purge concentration detected based on the detection value of the pressure sensor 17.

Accordingly, even when the purge concentration suddenly varies, the evaporated fuel treatment apparatus 1 can reduce the occurrence of A/F fluctuations.

After starting the control to estimate the purge concentration based on the detection value of the A/F sensor SE, the controller 10 may also be configured to change the purge flow rate within an allowable range in the engine EN according to the adsorption amount of evaporated fuel in the canister 11.

This configuration enables stable introduction of purge gas into the engine EN, irrespective of the adsorption amount of evaporated fuel in the canister 11.

The foregoing embodiments are mere examples and give no limitation to the present disclosure. The present disclosure may be embodied in other specific forms without departing from the essential characteristics thereof.

REFERENCE SIGNS LIST

1 Evaporated fuel treatment apparatus
10 Controller
11 Canister
12 Purge passage
13 Purge pump
14 Purge valve
17 Pressure sensor
100 Internal combustion engine system
EN Engine
IP Intake passage
SE A/F sensor
FT Fuel tank
IN Injector
A1, A2 Predetermined value
B Predetermined value
Tc Valve-closing time

What is claimed is:

1. An evaporated fuel treatment apparatus comprising:
a canister configured to store evaporated fuel;
a purge passage configured to allow purge gas containing the evaporated fuel to flow from the canister to an engine through an intake passage;
a purge pump configured to deliver the purge gas to the intake passage;
a purge valve configured to open and close the purge passage; and
a controller configured to drive the purge valve under duty control while driving the purge pump to execute purge control to introduce the purge gas from the canister to the engine through the purge passage and the intake passage,
wherein the evaporated fuel treatment apparatus further includes a pressure detecting unit configured to detect one of an ejection pressure of the purge pump and a front-rear differential pressure of the purge pump, and
the controller is configured to execute first purge concentration determination control after starting the purge control, the first purge concentration determination control including:
detecting a purge concentration representing a concentration of the evaporated fuel contained in the purge gas based on a detection value of the pressure detecting unit while gradually increasing a purge flow rate representing a flow rate of the purge gas in increments of a predetermined amount; and
prohibiting either changing of an operating state of the purge pump or changing of an open state of the purge valve until a detected concentration determination time at which a variation range of the purge concentration detected based on the detection value of the pressure detecting unit becomes equal to or less than a first predetermined value.

2. An evaporated fuel treatment apparatus comprising:
a canister configured to store evaporated fuel;
a purge passage configured to allow purge gas containing the evaporated fuel to flow from the canister to an engine through an intake passage;
a purge pump configured to deliver the purge gas to the intake passage;
a purge valve configured to open and close the purge passage; and
a controller configured to drive the purge valve under duty control while driving the purge pump to execute purge control to introduce the purge gas from the canister to the engine through the purge passage and the intake passage,
wherein the evaporated fuel treatment apparatus further includes a pressure detecting unit configured to detect one of an ejection pressure of the purge pump and a front-rear differential pressure of the purge pump, and
the controller is configured to execute second purge concentration determination control after starting the purge control, the second purge concentration determination control including:
detecting a purge concentration representing a concentration of the evaporated fuel contained in the purge gas based on a detection value of the pressure detecting unit while maintaining a purge flow rate representing a flow rate of the purge gas at a predetermined flow rate; and prohibiting both changing of an operating state of the purge pump and changing of an open state of the purge valve until a detected concentration determination time at which a variation range of the purge concentration detected based on the detection value of the pressure detecting unit becomes equal to or less than a first predetermined value.

3. The evaporated fuel treatment apparatus according to claim 1, wherein the controller is configured to perform a control to estimate the purge concentration based on an A/F of the engine on or after the detected concentration determination time, and after the detected concentration determination time and further an estimated concentration determination time at which a variation range of the purge concentration estimated based on the A/F of the engine becomes equal to or less than a second predetermined value, the controller is configured to control the purge flow rate and/or an injection amount of fuel to be injected by an injector into the engine based on the purge concentration estimated based on the A/F of the engine.

4. The evaporated fuel treatment apparatus according to claim 2, wherein the controller is configured to perform a control to estimate the purge concentration based on an A/F of the engine on or after the detected concentration determination time, and after the detected concentration determination time and further an estimated concentration determination time at which a variation range of the purge concentration estimated based on the A/F of the engine becomes equal to or less than a second predetermined value, the controller is configured to control the purge flow rate and/or an injection amount of fuel to be injected by an injector into the engine based on the purge concentration estimated based on the A/F of the engine.

5. The evaporated fuel treatment apparatus according to claim 3, wherein the controller is configured to perform the control to estimate the purge concentration based on the A/F of the engine after warm-up of the engine is completed.

6. The evaporated fuel treatment apparatus according to claim 4, wherein the controller is configured to perform the control to estimate the purge concentration based on the A/F of the engine after warm-up of the engine is completed.

7. The evaporated fuel treatment apparatus according to claim 3, wherein after the estimated concentration determination time, when a change rate of the A/F of the engine is equal to or larger than a predetermined change rate, the controller is configured to:

perform the first purge concentration determination control to detect the purge concentration based on the detection value of the pressure detecting unit while gradually increasing the purge flow rate in increments of the predetermined amount, and prohibit either changing of the operating state of the purge pump or changing of the open state of the purge valve until the detected concentration determination time; and control the purge flow rate and/or the injection amount of the injector based on the purge concentration detected based on the purge concentration detected based on the detection value of the pressure detecting unit.

8. The evaporated fuel treatment apparatus according to claim 5, wherein after the estimated concentration determination time, when a change rate of the A/F of the engine is equal to or larger than a predetermined change rate, the controller is configured to:

perform the first purge concentration determination control to detect the purge concentration based on the detection value of the pressure detecting unit while gradually increasing the purge flow rate in increments of the predetermined amount, and prohibit either changing of the operating state of the purge pump or changing of the open state of the purge valve until the detected concentration determination time; and control the purge flow rate and/or the injection amount of the injector based on the purge concentration detected based on the purge concentration detected based on the detection value of the pressure detecting unit.

9. The evaporated fuel treatment apparatus according to claim 4, wherein after the estimated concentration determination time, when a change rate of A/F of the engine is equal to or larger than a predetermined change rate, the controller is configured to:

perform the second purge concentration determination control to detect the purge concentration based on the detection value of the pressure detecting unit while maintaining the purge flow rate at the predetermined flow rate, and prohibit both changing of the operating state of the purge pump and changing of the open state of the purge valve until the detected concentration determination time; and control the purge flow rate and/or the injection amount of the injector based on the purge concentration detected based on the purge concentration detected based on the detection value of the pressure detecting unit.

10. The evaporated fuel treatment apparatus according to claim 6, wherein after the estimated concentration determination time, when a change rate of A/F of the engine is equal to or larger than a predetermined change rate, the controller is configured to:

perform the second purge concentration determination control to detect the purge concentration based on the detection value of the pressure detecting unit while maintaining the purge flow rate at the predetermined flow rate, and prohibit both changing of the operating state of the purge pump and changing of the open state of the purge valve until the detected concentration determination time; and control the purge flow rate and/or the injection amount of the injector based on the purge concentration detected based on the purge concentration detected based on the detection value of the pressure detecting unit.

11. The evaporated fuel treatment apparatus according to claim 3, wherein the controller is configured to start the estimation of the purge concentration based on the A/F of the engine and then change the purge flow rate in an allowable range in the engine according to an adsorption amount of the evaporated fuel in the canister.

12. The evaporated fuel treatment apparatus according to claim 4, wherein the controller is configured to start the estimation of the purge concentration based on the A/F of the engine and then change the purge flow rate in an allowable range in the engine according to an adsorption amount of the evaporated fuel in the canister.

13. The evaporated fuel treatment apparatus according to claim 5, wherein the controller is configured to start the estimation of the purge concentration based on the A/F of the engine and then change the purge flow rate in an allowable range in the engine according to an adsorption amount of the evaporated fuel in the canister.

14. The evaporated fuel treatment apparatus according to claim 6, wherein the controller is configured to start the estimation of the purge concentration based on the A/F of the engine and then change the purge flow rate in an allowable range in the engine according to an adsorption amount of the evaporated fuel in the canister.

15. The evaporated fuel treatment apparatus according to claim 7, wherein the controller is configured to start the estimation of the purge concentration based on the A/F of the engine and then change the purge flow rate in an allowable range in the engine according to an adsorption amount of the evaporated fuel in the canister.

16. The evaporated fuel treatment apparatus according to claim 8, wherein the controller is configured to start the estimation of the purge concentration based on the A/F of the engine and then change the purge flow rate in an allowable range in the engine according to an adsorption amount of the evaporated fuel in the canister.

17. The evaporated fuel treatment apparatus according to claim 9, wherein the controller is configured to start the estimation of the purge concentration based on the A/F of the engine and then change the purge flow rate in an allowable range in the engine according to an adsorption amount of the evaporated fuel in the canister.

18. The evaporated fuel treatment apparatus according to claim 10, wherein the controller is configured to start the estimation of the purge concentration based on the A/F of the engine and then change the purge flow rate in an allowable range in the engine according to an adsorption amount of the evaporated fuel in the canister.

19. An evaporated fuel treatment apparatus comprising:

a canister configured to store evaporated fuel;

a purge passage configured to allow purge gas containing the evaporated fuel to flow from the canister to an engine through an intake passage;

a purge pump configured to deliver the purge gas to the intake passage;

a purge valve configured to open and close the purge passage; and a controller configured to drive the purge valve under duty control while driving the purge pump to execute purge control to introduce the purge gas from the canister to the engine through the purge passage and the intake passage, wherein after an estimated concentration determination time at which a variation range of a purge concentration representing a concentration of the evaporated fuel contained in the purge gas estimated based on an A/F of the engine becomes equal to or less than a predetermined value, the controller is configured to control a purge flow rate representing a flow rate of the purge gas and/or an injection amount of fuel to be injected by an injector to the engine based on the purge concentration estimated on the A/F of the engine.

* * * * *